United States Patent [19]

Kasha

[11] 4,079,654

[45] Mar. 21, 1978

[54] BRACING STRUCTURE FOR STRINGED MUSICAL INSTRUMENT

[75] Inventor: Michael Kasha, Tallahassee, Fla.

[73] Assignee: Norlin Music, Inc., Lincolnwood, Ill.

[21] Appl. No.: 576,281

[22] Filed: May 12, 1975

[51] Int. Cl.[2] ..... G10D 3/02

[52] U.S. Cl. ..... 84/291

[58] Field of Search ..... 84/195, 267, 276, 291

[56] References Cited

U.S. PATENT DOCUMENTS

| | | | |
|---|---|---|---|
| 72,591 | 12/1867 | Bini | 84/291 |
| 765,019 | 7/1904 | Larson | 84/267 |
| 897,036 | 8/1908 | Ulbrich | 84/291 |
| 1,183,369 | 5/1916 | Gardie | 84/291 X |
| 1,680,180 | 8/1928 | Siegel | 84/195 X |
| 1,764,679 | 6/1930 | Gast | 84/267 X |
| 2,186,424 | 1/1940 | Moertel | 84/267 |
| 2,204,150 | 6/1940 | Quattrociocche | 84/267 |
| 3,443,465 | 5/1969 | Kasha | 84/267 |
| 3,656,395 | 4/1972 | Kaman | 84/267 |
| 3,685,385 | 8/1972 | Rendell | 84/267 |
| 3,892,159 | 7/1975 | Houtsma | 84/291 X |

*Primary Examiner*—Lawrence R. Franklin
*Attorney, Agent, or Firm*—Ronald J. Kransdorf

[57] ABSTRACT

This invention relates to an improved bracing structure for a stringed musical instrument of the type having lower frequency or bass strings and higher frequency or treble strings, and a bridge through which the strings are coupled to a soundboard structure. The bracing structure is formed on the underside of the soundboard and serves both a mechanical-structural and a mechanical-sonic, or acoustical function. The structural function is to protect the soundboard from damage resulting from the torsional forces resulting from the pull of the strings on the bridge, which forces are transmitted through to the soundboard. This function is accomplished by a torsion bar positioned substantially in axial alignment with the bridge, torsional forces applied by strings to the bridge being transmitted through the soundboard to the torsion bar, and a framing bar structure physically connected to and acting through the torsion bar to distribute the torsional forces from the bridge area of the soundboard. These torsional forces may be distributed by the framing bar structure to the elements structurally supporting the soundboard or may be distributed only over a larger area of the soundboard.

The sonic or acoustical function is accomplished by a pattern of acoustical bars attached to the underside of the soundboard and oriented in a predetermined pattern which pattern is adapted to permit the soundboard to vibrate optimally at different frequencies in different zones thereof and by a boundary structure which limits the zones of the soundboard which may vibrate at selected frequency ranges and inhibits the formation of antinodes outside of these limited zones. The boundary structure includes, for the preferred embodiments of the invention, peripheral bars generally located at a boundary of the limited zones in which vibration at selected frequencies occur and stiffening bars positioned in regions where vibrations are not to occur.

24 Claims, 11 Drawing Figures

Fig. 1.
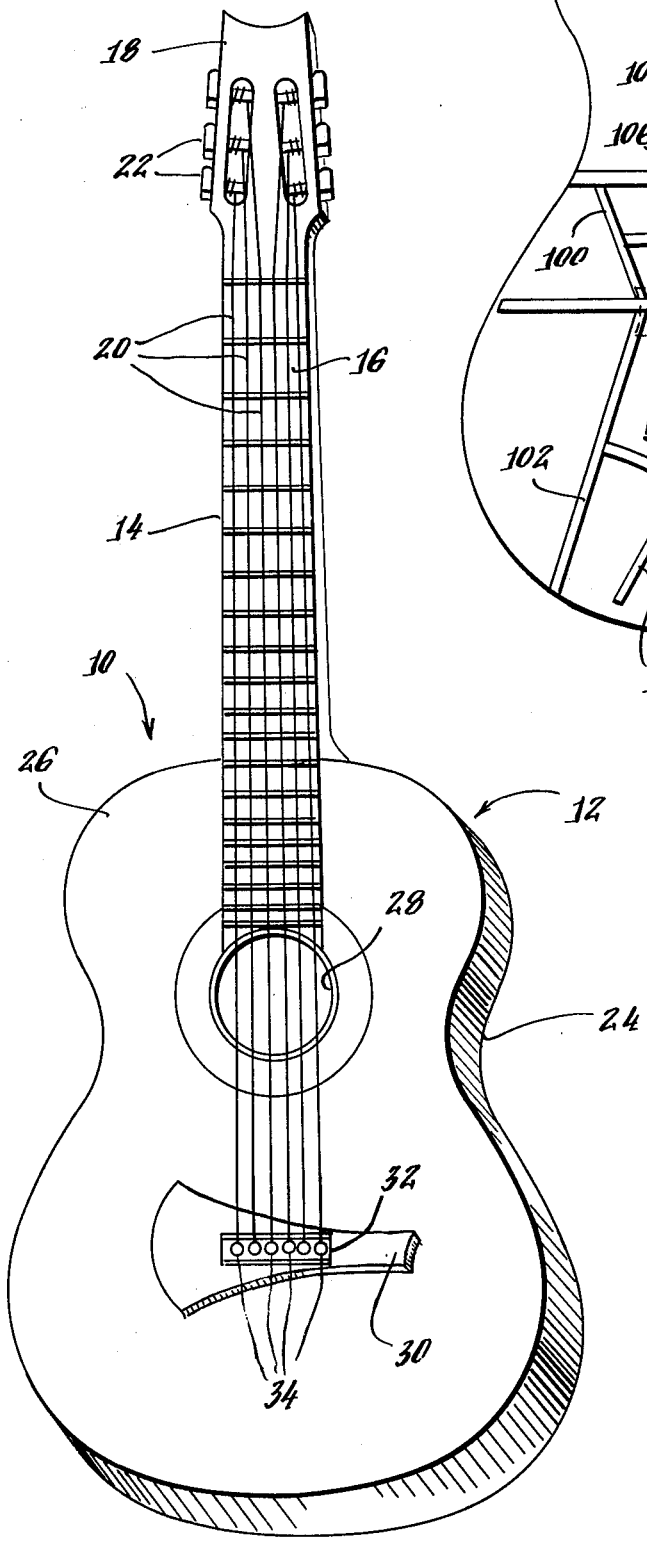
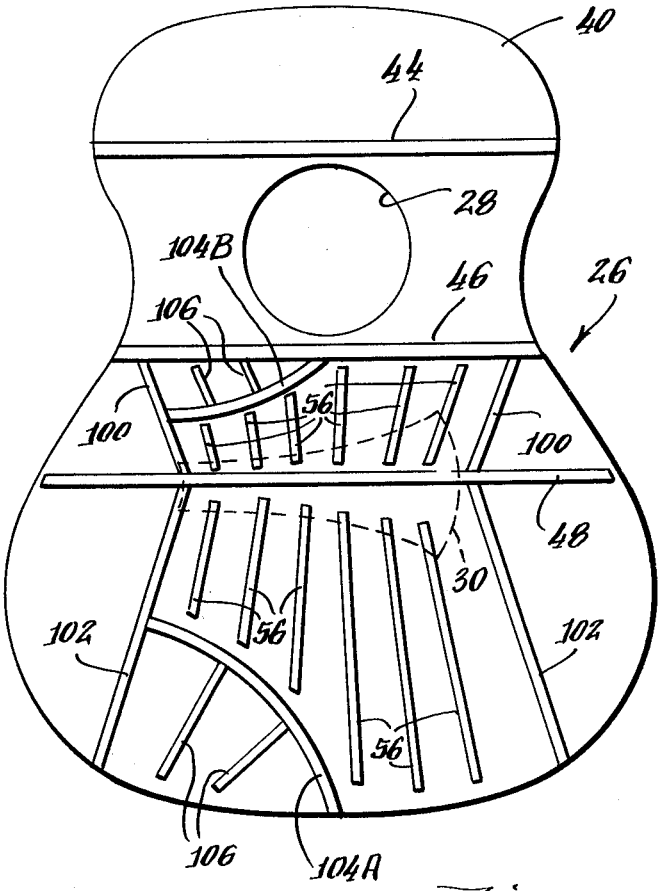
Fig. 10.

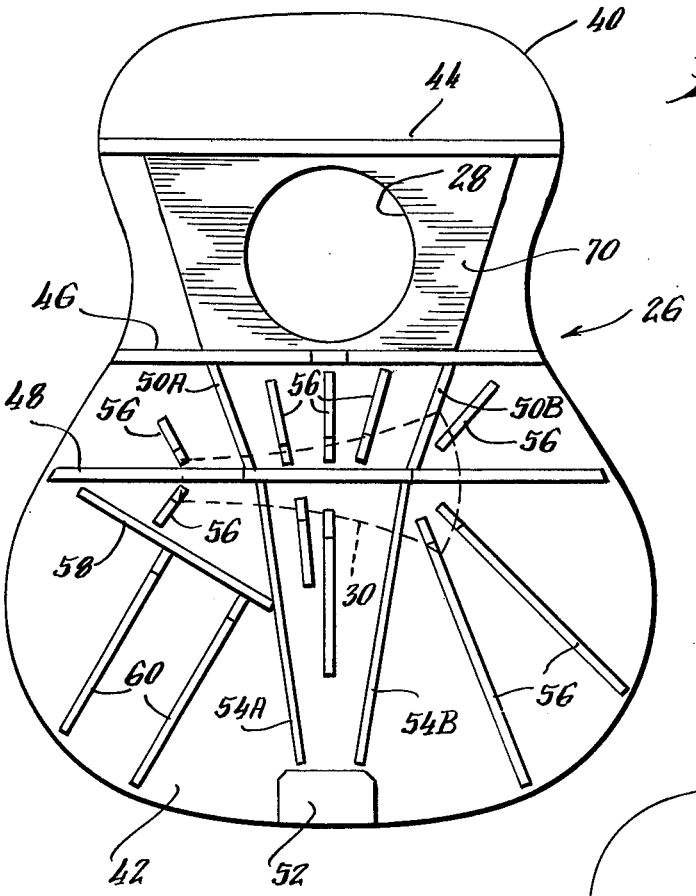
Fig. 4.
Fig. 5.
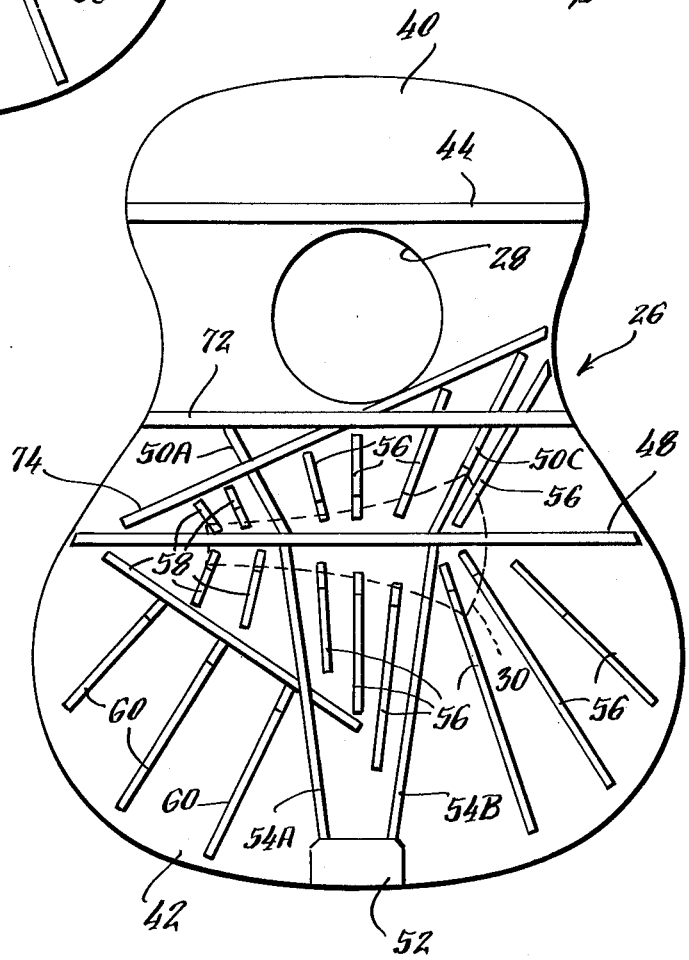
Fig. 6.
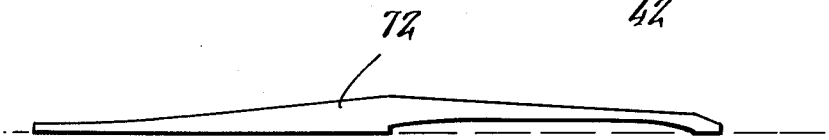

BRACING STRUCTURE FOR STRINGED MUSICAL INSTRUMENT

BACKGROUND

1. Field of the Invention

This invention relates to stringed musical instruments and more particularly to an improved bracing structure for the soundboards of such instruments.

2. The Prior Art

In stringed musical instruments such as guitars, violins, pianos, and the like, a plurality of tightly stretched strings pass over a bridge structure, the bridge structure physically engaging the instrument soundboard. The soundboard forms one side of an airfilled cavity. When one or more strings are caused to vibrate by being struck, bowed, or otherwise, the frequency at which the string vibrates is determined by the material and length of the string, its tension, and by its caliper (thickness or weight.) In addition to vibrating at the fundamental frequency of the string determined by the factors indicated above, the string also vibrates at certain higher harmonics of this frequency, the extent of these higher harmonics depending upon a number of factors including the caliper and tension of the string. Such string vibration alone is largely inaudible, primarily because of air circulation around the vibrating string.

The bridge mechanically couples the vibration of the string or strings to the instrument soundboard causing vibration of the soundboard which is a function both of the vibrating frequencies of the strings(s) and of the physical characteristics of the soundboard. Ideally, the soundboard should vibrate with substantially uniform amplitude over the full frequency range of the instrument, providing a substantially uniform, accurate response. However, since the soundboard is essentially a vibrating plate, it has its own limitation on natural vibrating frequencies and careful design is therefore required in order to achieve the desired frequency response. Vibrations of the soundboard are coupled to the resonant cavity of the instrument causing vibrations therein, which likewise are a function both of the coupled vibrations of the soundboard and of the resonant characteristics of the cavity. The sound output from the instrument is determined primarily by the vibrations of the soundboard and the cavity.

Thus, it is seen that both the tonal characteristics and the strength or intensity of the sound obtained from a stringed musical instrument are dependent to a large extent on the characteristics of the instrument soundboard. While the teachings of this invention are suitable for application with the soundboards of most stringed musical instruments, for purposes of illustration, the discussion to follow will be concerned primarily with the soundboards of accoustical guitars. An acoustic guitar has a number of strings, such as, for example, six strings, with higher frequency or treble strings on one side and lower frequency or bass strings on the other side, the strings vibrating at successively lower frequency as one moves from the treble side to the bass side. These strings, particularly in steel string models, are under substantial tension. Because of the manner in which the strings are mounted, the strings apply static rotational or torsional forces to the bridge. The forces applied to the bridge also vary dynamically as the string is vibrated. Since the bridge is attached to the soundboard, the torsional forces applied to the bridge are transmitted through the bridge to the area of the soundboard directly thereunder. These relatively large forces applied to a relatively small area can cause bending, cracking, or other damage to the soundboard and are one of the principal causes of the soundboard failure.

In order to protect the soundboard against damage due to torsional forces, attempts have been made to strengthen or stiffen the soundboard by securing bracing members to the under side of the soundboard and by other means. However, in addition to transmitting torsional forces to the soundboard, the bridge also transmits the forces resulting from string vibration to the soundboard. In order to achieve full, brilliant tones from the guitar, the soundboard must be able to vibrate strongly in response to these vibrational forces. However, an overly stiff soundboard tends to damp these vibrational forces, resulting in a dull, weak, clearly undesirable sound output. Thus, a conflict has for some time existed between the mechanical and the sonic requirements of the soundboard.

Fortunately, the undesired torsional forces applied to the soundboard are in a direction parallel to the plane of the soundboard whereas the desired vibrational forces are in a direction perpendicular to the plane of the soundboard. Therefore, it is possible, in accordance with the teachings of this invention, to provide a soundboard having the required strength against torsional forces while still being adapted to respond strongly to vibrational forces, providing a strong, brilliant output.

Since the soundboard is essentially a vibrating plate, its geometry causes it to have certain natural resonant characteristics. The soundboard thus responds more strongly to certain applied vibrational frequencies, and less strongly to other frequencies. Heretofore, no systematic effort has been made to provide an instrument adapted to respond uniformly over the full frequency range of the instrument, or alternatively, to respond in accordance with a predetermined response characteristic. Instead, the response characteristics of a particular instrument have been more or less empirically selected. In particular, attempts have been made to control the acoustic response of the soundboard through the use of bracing bar patterns attached to the underside of the soundboard. The purpose of these patterns is to define certain zones of the soundboard in which it will be permitted to vibrate at certain frequencies, and other zones in which the soundboard is permitted to vibrate at other frequencies. However, because of the manner in which these bars have been placed, they frequently served to define nodes rather than perimeters, with antinode vibrations occurring in regions of the soundboard outside of the desired zones. These antinode vibrations cause energy losses which weaken the output from the instrument and muddy the outputs obtained therefrom.

From the above, it is clear that a systematic approach to the design of the soundboard, and in particular to the design of the bracing pattern for the soundboard, of stringed musical instruments in general, and guitars in particular, is required. Such a systematic design should provide the required structural strength to permit the soundboard to withstand the torsional forces applied thereto while not interfering with the sonic or acoustical vibrations of the instrument and should permit strong vibration of the instrument at each desired frequency in a selected zone thereof, without permitting antinode vibrations to occur outside the selected zones.

In accordance with the above, this invention provides a bracing structure formed on the underside of the soundboard of a stringed musical instrument having lower frequency or bass strings and higher frequency or treble strings, the soundboard being coupled to these strings through a bridge structure. The bracing structure includes a torsion bar positioned substantially in axial alignment with the bridge, torsional forces applied by the strings to the bridge being transmitted to the torsion bar and through the torsion bar to the soundboard and the frame of the instrument. Framing means are provided which are physically connected to and act through the torsion bar to distribute the torsional forces from the bridge area of the soundboard. For preferred embodiments, means are provided for structurally supporting the soundboard and the framing means includes means for distributing the torsional forces to the means for structurally supporting. For preferred embodiments, the framing means also includes a plurality of framing bars, each of which is attached at one end to the torsion bar and extends along the underside of the soundboard in a predetermined direction away from the torsion bar, each of the framing bars being attached to the underside of the soundboard and serving to transmit the forces applied to the bridge area of the soundboard over a larger area thereof.

The bracing structure also includes a plurality of acoustical bars attached to the underside of the soundboard and oriented in a predetermined pattern, said bar pattern being adapted to permit the soundboard to vibrate optimally at different frequencies in different zones thereof, and boundary means for limiting the zones of the soundboard which may vibrate at selected frequency ranges, and for inhibiting the formation of antinodes outside of these limited zones. For preferred embodiments, the boundary means includes stiffening means attached to the underside of the soundboard in the regions thereof outside of the limited zones which may vibrate at the selected frequency ranges. More specifically, the boundary means includes at least one peripheral bar attached to the underside of the soundboard and positioned substantially at the junction between a limited zone and a region outside the limited zone, and the stiffening means are stiffening bars attached to the underside of the soundboard in the outside region.

The foregoing and other objects, features and advantages of the invention will be more apparent from the following more particular description of preferred embodiments of the invention as illustrated in the accompanying drawings.

BRIEF DESCRIPTION OF THE DRAWINGS

FIG. 1 is a top perspective view of an acoustic guitar in which the bracing structure of this invention may be utilized.

FIG. 4 is a schematic view of a soundboard of a second embodiment of the invention as observed from the underside.

FIG. 5 is a schematic view of a soundboard of a third embodiment of the invention as observed from the underside.

FIG. 6 is a side view of a waist bar suitable for use in the embodiment of the invention shown in FIG. 5.

FIG. 10 is a schematic view of a soundboard of a sixth embodiment of the invention as observed from the underside.

DETAILED DESCRIPTION

Figure 2:
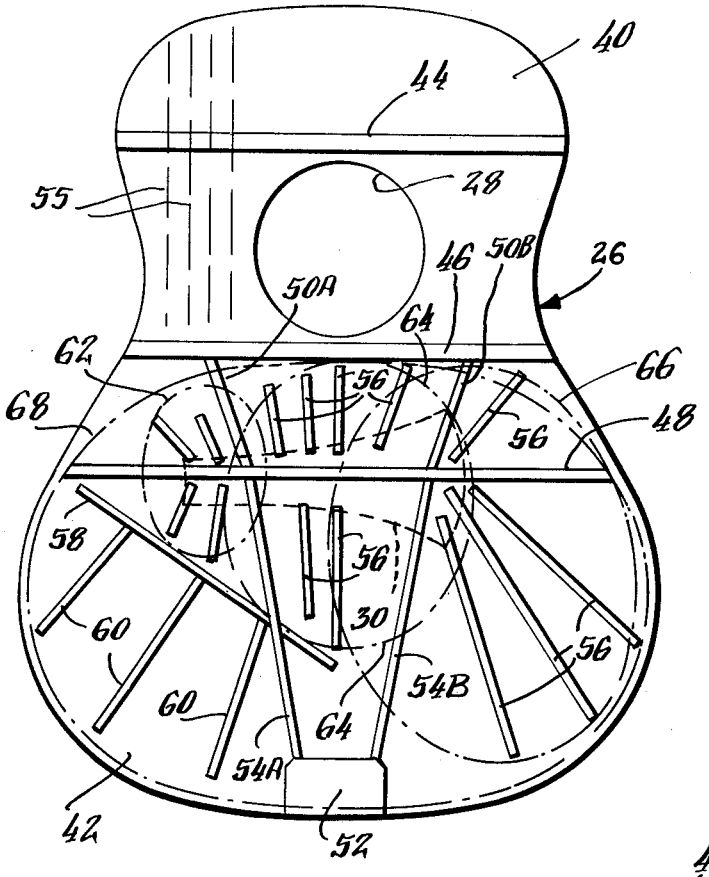
FIG. 2 is a schematic view of a guitar soundboard incorporating the bracing structure of a first embodiment of this invention as observed from the underside.

Referring now to FIG. 1, an acoustical or classical guitar 10 of the type in which the bracing structure of this invention may be utilized is shown. The guitar has a body 12 with a neck 14 extending therefrom. The neck has a fretted fingerboard 16 secured to the top thereof and terminates in a pegboard 18. Strings 20 are secured at one end to pegs 22 mounted in peghead 18 and extend over fingerboard 16 to body 12. Body 12 has side walls 24 with a bottom board (not shown) secured on one side of the sidewalls and a soundboard 26 secured to the other side of the side walls, a sound cavity being formed inside of the body. Soundboard 26 has a soundhole 28 formed therein and has a bridge 30 secured thereto at a point somewhat below the sound hole. The bridge has a bridge saddle 32 over which strings 20 pass and pegs 34 which hold the far end of the strings in place. Strings 20 are stretched tightly between pegs 22 and pins 34 and thus tend to apply certain static rotational or torsional forces to bridge saddle 32, and through the bridge saddle and bridge 30 to the area of soundboard 26 adjacent to bridge 30. Strings 20 are of varying thickness and weight with the strings on the left side of FIG. 1 being thicker low frequency or bass strings and the strings on the right side of FIG. 1 being thinner higher frequency or treble strings.

Referring now to FIG. 2, the underside of a soundboard 26 having the bracing structure of a first embodiment of the invention is shown. While the shape of the soundboard does not form part of the present invention, the soundboards of acoustical guitars normally have a small upper bout or section 40 and larger lower bout or section 42 with a narrowed waist therebetween. An upper bout transverse or bracing bar 44 which does not form part of the present invention is secured to the soundboard above soundhole 28 and a waist bar 46 is secured to the soundboard in a position just under the sound hole. For the embodiment of the invention shown in FIG. 2, vibrations of the soundboard which are of interest occur mainly in the portion 42 thereof which is under waist bar 46.

A torsion bar 48 is secured to the soundboard in a manner such that it is in axial alignment with bridge 30. While bar 48 may extend all the way to the walls 24 of the guitar body, for the embodiment of the invention shown in FIG. 2, this bar terminates just short of the walls. A pair of framing bars 50 extend at an angle between waist bar 46 and torsion bar 48, and are in physical contact with both of these bars. For a preferred embodiment of the invention, framing bars 50 will be glued to both bars 46 and 48. An end block 52 is secured to the underside of the soundboard and is also in physical contact with walls 24 (see FIG. 1.) A pair of framing bars 54 extend at an angle between torsion bar 48 and end block 52 and are in physical contact with both the bar and the end block. Framing bars 54 may also be glued or otherwise secured to bar 48 and end block 52. The function of torsion bar 48 and framing bars 50 and 54 is to distribute the torsional or rotational forces transmitted by bridge 30 to soundboard 26 from the area of the soundboard under the bridge. Thus, these torsional forces are transmitted by the torsion bar 48 to the soundboard. This tends to distribute the torsional forces over the area of the soundboard over the torsion bar. The forces transmitted to the torsion bar are also transmitted to framing bars 50 and 54 and through the framing bars to waist bar 46 and end block 52. Finally, the forces are transmitted through waist bar 46 and end block 52 to the walls 24 (FIG. 1) of guitar body 12. Thus, instead of the torsional forces being concentrated in the relatively small area of the soundboard under bridge 30, they are distributed over the relatively large area of the soundboard covering torsion bar 48, framing bars 50 and 54, waist bar 46, and end block 52 and are further distributed to the walls of the guitar body. With the forces being thus distributed, minimal force is applied to any given point on the soundboard and the possibility of these forces damaging the soundboard is thus minimized.

Lines 55 illustrate the direction for the grain of the wood used to form soundboard 26. If framing bars 50 and 54 are oriented parallel to the direction of the grain, it can cause a fault to develop in the soundboard in the area over the framing bars. Thus, the framing bars 50 and 54 are oriented in a direction at an angle to the grain of the wood.

In addition to the bracing bars described above which perform a substantially mechanical structural function, there are also a plurality of acoustic bars 56 attached to the underside of soundboard 26. Since in FIG. 2 it is the underside of soundboard 26 which is being viewed, the bass and treble sides of the soundboard are reversed from the positions shown in FIG. 1. Thus, the left side of the soundboard shown in FIG. 2 is the treble side and the right side is the bass side. It is thus seen that acoustic bars 56 are the shortest on the treble side and increase in length when moving toward the bass side of the instrument, being longest on the bass side. The reasons for this variation in length will be described shortly. It is also noted that acoustic bars 56 do not contact torsion bar 48. The reason for this will also be described later.

Finally, a peripheral bar 58 is positioned adjacent to the lower ends of the treble ones of the acoustic bars 56. Stiffening bars 60 are attached at one end to peripheral bar 58 and extend toward the lower edge of the soundboard at an angle substantially perpendicular to the plane of the peripheral bar.

With the bracing bar configuration shown in FIG. 2, high frequency or treble vibrations occur substantially in a zone such as zone 62 centered at the treble side of bridge 30. Lower frequency vibrations occur in successively larger zones centered at lower frequency portions of the bridge. Thus, vibrations for a typical midrange frequency might occur in a zone 64 while vibrations for a particular bass frequency might occur in a zone 66. For the lowest frequency vibrations of the instrument, the vibrating zone includes substantially all of the lower bout 42 of the soundboard, this zone being indicated by the reference numeral 68. As may be seen in FIG. 2, acoustic bars 56 serve to define the zones which vibrate at selected frequencies and facilitate the vibrating of each zone at its proper frequency. This is the reason that the bars 56 are of different length and the reason that the bars are not attached to the torsion bar 48 or any of the framing bars.

However, as may be seen in FIG. 2, bars 56 are not alone sufficient to define zones such as zone 62 for treble vibrations and have only limited effect in defining zones such as zone 64 for midrange vibration. Peripheral bar 58 is thus provided to assist in defining these zones. While attempts have been made in the past to define vibrating zones by use of peripheral bars, a peripheral bar used alone serves as a nodal rather than as a boundary element, antinode vibration occuring in the soundboard region on the opposite side of the peripheral bar from the zone in which vibrations are desired. These antinodes waste energy and thus reduce the strength and brilliance of the sound output. The antinodes also tend to muddy the sound output. In this invention, the formation of such antinodes is prevented by the stiffening bars 60.

Figure 3:
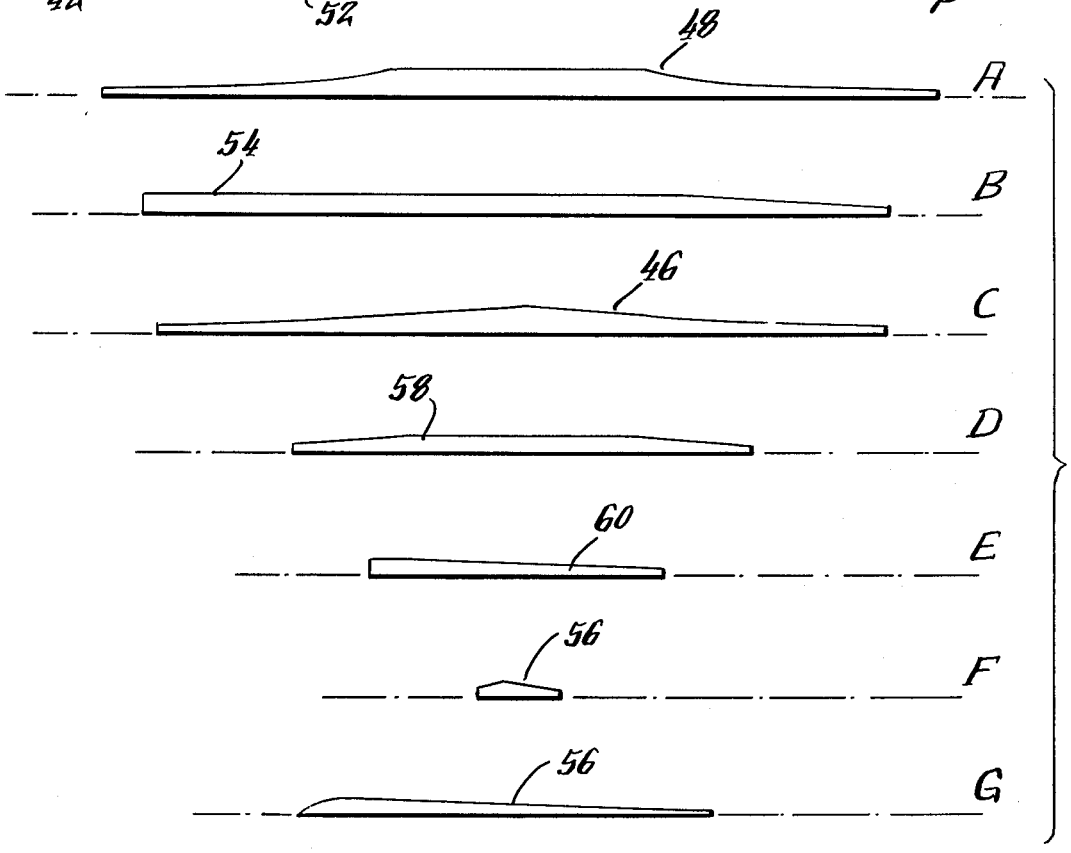
FIGS. 3A through 3G are side views of selected ones of the bracing bars shown in FIG. 2.

As indicated previously, a conflict exists in the design of bracing structures for stringed musical instruments between the mechanical strength and stiffness required for the soundboard and the sonic requirements that the soundboard be able to vibrate strongly in response to the vibrational forces applied thereto. To assist in resolving this conflict, the torsion bar 48 is designed so that it is thickest at its center and tapers toward each end (see FIG. 3A.) Thus, this bar is capable of providing the required mechanical strength while having a minimal damping effect particularly on the low frequency vibrations such as occur for example in zone 68. The framing bars 50 and 54 are similarly thicker at their ends adjacent to the torsion bar and taper as they move away from this bar. A typical framing bar 54 is shown in FIG. 3B. The waist bar 46 (FIG. 3C) and the peripheral bar 58 (FIG. 3D) are tapered in a manner similar to the torsion bar while the stiffening bars 60 (FIG. 3E) are tapered in a manner similar to the framing bars. The tapered profile for a typical treble acoustical bar is shown in FIG. 3F and the profile for a typical bass acoustical bar is shown in FIG. 3G. The cross section of a typical acoustical bar is shown in FIG. 11.

Figure 11:
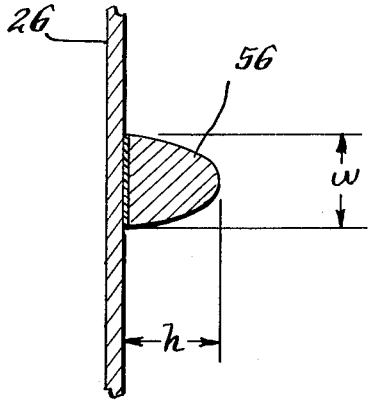
FIG. 11 is a cross sectional view of a typical bracing bar.

In connection with FIG. 11, it is noted that the ratio of the height ($h$) to the width ($w$) is known as the aspect ratio of the bar. The aspect ratio for all of the acoustic bars 56 may be the same; however, superior acoustical results can be obtained if the aspect ratio for the bars 56 in the treble zones, such as zone 62, is greater than the aspect ratio for the bars in the bass zones such as zone 66. However, the aspect ratio of the bars may also be utilized to control the sound obtained from the instrument. Thus, a high aspect ratio for the bars provides a typanic onset transient resulting in a bright, jazzy sound from the instrument. A low aspect ratio for the bars results in a more sombre classical sound.

FIG. 4 shows an alternative embodiment of the invention. Referring now to FIG. 4, an embodiment of the invention is shown therein which is substantially the same as that shown in FIG. 2. However, this embodiment of the invention provides adequate results at lower cost by utilizing a lesser number of acoustical bars 56, by utilizing a shorter peripheral bar 58, which is limited substantially to the treble region, and by employing only two rather than three stiffening bars 60. In addition, the junction of the framing bars 54A and B to end block 52 has been eliminated, so that framing bars 54 merely serve to distribute the torsional forces over a larger area of the soundboard rather than distributing these forces to side walls 24 (FIG. 1.) One addition for this embodiment of the invention is the soundhole plate 70 which extends between and is connected to bars 44 and 46 on either side of soundhole 28; the taper of this plate is in accordance with avoiding wood-grain splitting. This plate provides additional structural strength to the soundboard, and also serve to stiffen the soundboard in this area preventing the formation of antinodes therein.

FIG. 5 shows still another embodiment of the invention. From FIG. 2, it is seen that while peripheral bar 58 defines the lower end of treble and midrange zones such as 62 and 64, the upper ends of these zones are not fully defined and delimited. Further, waist bar 46 tends to limit vibrations to lower bout 42 of the soundboard resulting in the vibrating zones, particularly for the lower frequencies, being somewhat distorted rather than being substantially circular. In FIG. 5, the waist bar 46 has been replaced by a waist bar 72 which, as may be seen better in FIG. 6, is partially floating. This permits the upper acoustical bars 56 for the bass region to extend under the waist bar, expanding the zones in which lower frequency or bass vibrations occur. Since waist bar 72 is floating on the right side, the upper framing bar 50 on this side cannot be attached thereto. Thus, framing bar 50B has been replaced by a framing bar 50C which is longer than the bar 50B, and extends under waist bar 72. Framing bar 50C functions to distribute torsional forces over the soundboard but does not distribute them to the walls of the guitar body as did bar 50B. Bar 50C also is tapered so as to be capable of functioning as a bass acoustical bar as well as a framing bar.

Finally, a second peripheral bar 74 has been provided which defines the upper boundary of the treble, midrange and bass zones. While stiffening bars 60 have not been provided for peripheral bar 74, framing bar 50A partially serves this function in the treble regions. In addition, the area between peripheral bar 74 and bar 44 in the bass region is too small to permit low frequency antinodes to be important. The design of FIG. 5 offers few compromises acoustically; however, this design is significantly more expensive to execute than those previously discussed.

Figure 7:
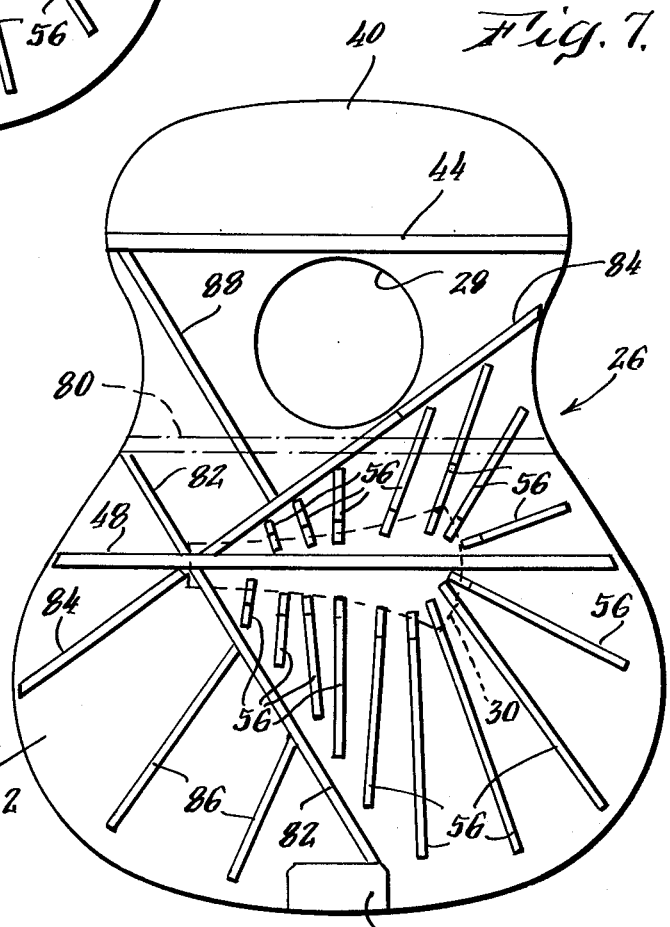
FIG. 7 is a schematic view of a soundboard of a fourth embodiment of the invention as viewed from the underside.
Figure 8:
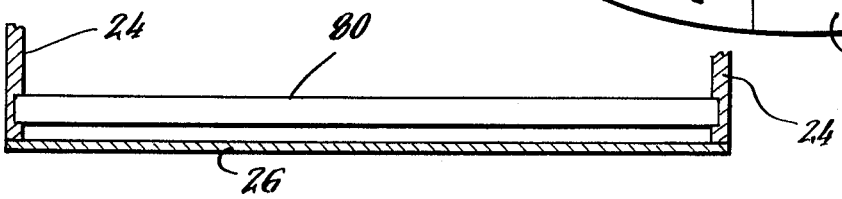
FIG. 8 is a side view of a waist bar suitable for use in the embodiment of the invention as shown in FIG. 7.

FIG. 7 shows an embodiment of the invention which offers the widest frequency range coupling possible in an acoustic guitar. For this embodiment of the invention, a floating waist bar 80 such as is shown in FIG. 8 is utilized. If some contact of the waist bar with the soundboard is desired, an arched waist bar (not shown) may be substituted for the floating bar 80. Acoustic bars 56 are provided with some of the upper bars in the bass zone passing under floating waist bar 80. Since these bars originate at a position under bridge 30, they serve to dissipate some of the torsional forces applied to the soundboard in the bass regions, thus serving both a mechanical and a sonic function. In addition, a pair of crossed framing bars 82 and 84 are provided which bars serve both as framing bars to dissipate torsional forces, particularly those in the region near the treble end of the bridge, over a wider area of the soundboard and to the side walls of the guitar body, and as peripheral bars. A pair of stiffening bars 86 are attached to bar 82 and serve both as stiffening bars and as framing bars. Similarly, a bar 88 interconnects bar 84 and bar 44, this bar similarly serving both as a stiffening bar and as a framing bar.

With this embodiment of the invention, the treble bars are confined to a treble zone sharply bounded by the X-bracing bars 82 and 84, which serve also as perimeter bars. Bass ones of the bars 56 are of maximum length for best bass response. The entire top may be conditioned for maximum response by utilizing a tapered profile, as previously indicated, for all bars, especially the X-bracing bars 82 and 84. The chief difficulty with this design is in balancing the tension resistance and the dissipation of torsional forces at the two ends of the bridge.

Figure 9:
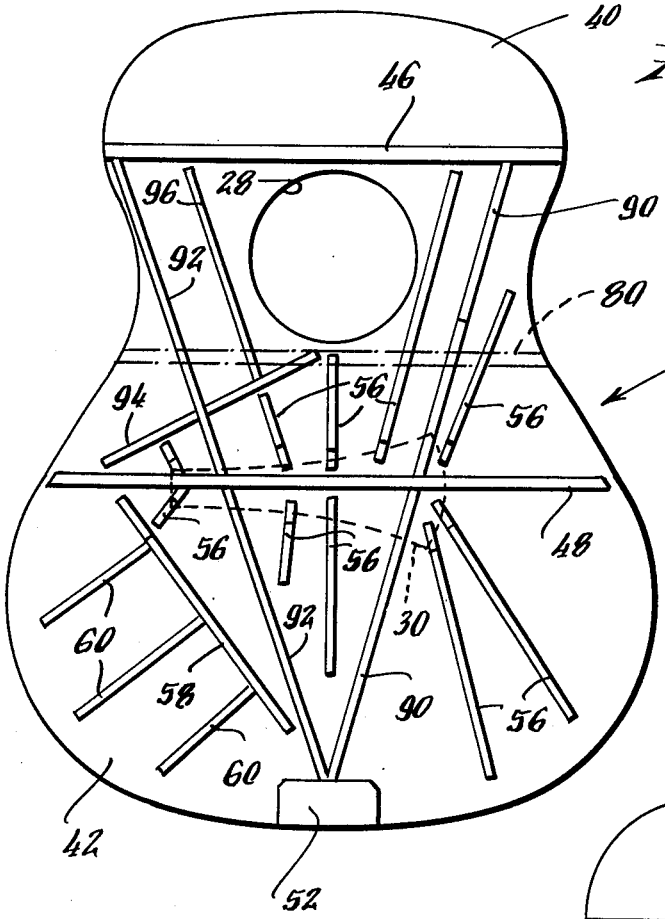
FIG. 9 is a schematic view of a soundboard of a fifth embodiment of the invention as viewed from the underside.

FIG. 9 shows another embodiment of the invention which also offers a wide-range frequency response. Here again a floating waist bar 80 has been utilized (an arched waist bar could also be used.) The bridge torsional forces are distributed between end block 52 and upper bout transverse bar 46 (the two strongest parts of the instrument) via framing bars 90 and 92 which bars are arranged in a straight-V bracing pattern. It is noted that the upper end of framing bar 90 is tapered and the portion of this bar between torsion bar 48 and transverse bar 46 serves the additional function of an extra long mechano-sonic bar for bass driving. The upper portion of the treble zone and to some extent of the midrange zone is defined by a peripheral bar 94. The upper portion of framing bar 92 and stiffening bar 96 serve to prevent antinodes from forming in the region above peripheral bar 94. One problem with this structure is that, particularly on the treble side, bar 92 interrupts the mechano-acoustical structure of the instrument; and, for this reason, this design is inferior to some of the previously disclosed embodiments.

FIG. 10 shows a final embodiment of the invention in which torsion bar 48 is interconnected with waste bar 46 by a pair of angled framing bars 100 and torsion bar 48 is connected to the side walls of the guitar body by a pair of lower framing bars 102. A pair of hyperbolically curved peripheral bars 104 define the treble zones, stiffening bars 106 being provided to prevent antinodes from forming outside of these zones. The curved peripheral bars shows in FIG. 10 more accurately define the boundaries of the vibrating zones in the treble region, the straight peripheral bars previously shown being compromise approximations for the boundaries of these zones. However, the curved bars are somewhat more expensive and the straight bars generally offer an adequate compromise.

While a number of embodiments have been shown above, other variations in bracing bar structure embodying the teachings of this invention will suggest themselves to those skilled in the art. It is also apparent that, while the discussion above has been limited to guitar embodiments, the teachings of this invention are equally applicable to the soundboards of other stringed musical instruments. Thus, while the invention has been particularly shown and described above with reference to preferred embodiments thereof, it will be understood that the foregoing and other changes in form and detail may be made therein without departing from the spirit and scope of the invention.

What is claimed is:

1. In a stringed musical instrument having a soundboard, a bridge, and strings extending over the bridge longitudinally of said soundboard, a bracing structure comprising:

a torsion bar fixed to the underside of said soundboad under said bridge and positioned substantially in axial alignment with said bridge, said torsion bar having a relatively thick dimension perpendicular to said soundboard; and framing means including a plurality of framing bars fixed to the underside of said soundboard and extending generally longitudinally of said soundboard, each of said framing bars having one end abutting said perpendicular dimension of said torsion bar, whereby torsional forces applied by said strings to said bridge are transmitted to said torsion bar and distributed from the bridge area of the soundboard by said framing bars.

2. A bracing structure as claimed in claim 1, wherein means are provided for structurally supporting said soundboard; and wherein said framing means includes means for distributing said torsional forces to said means for structurally supporting.

3. A bracing structure as claimed 1, wherein said framing bars are attached at said one end to said torsion bar.

4. A bracing structure as claimed in claim 1 wherein said instrument is a guitar, the guitar soundboard being attached to and supported by the walls of the guitar body, the soundboard having a narrowed waist at a predetermined distance above said bridge; including a waist bar attached to the underside of said soundboard at the soundboard waist and extending from one wall of the body to the other; and wherein at least one of said framing bars extends between and has its opposite ends attached to said torsion bar and said waist bar.

5. A bracing structure as claimed in claim 1 wherein said instrument is a guitar, the guitar soundboard being attached to and supported by the walls of the guitar body;

and wherein at least one of said framing bars extends between and has its opposite ends attached to said torsion bar and a selected point on the walls of the guitar body.

6. A bracing structure as claimed in claim 1 wherein said instrument is a guitar having an end-block attached to the guitar body frame; and wherein at least one of said framing bars extends between and has its opposite ends attached to said torsion bar and said end block.

7. A bracing structure as claimed in claim 1 wherein said soundboard is of wood, the wood having a grain extending in a predetermined direction; and wherein the predetermined direction in which each of said framing bars extends is at an angle to the direction of said grain.

8. A bracing structure as claimed in claim 1 wherein said instrument is a guitar, said soundboard being attached to and supported by the walls of the guitar body; and wherein said framing means has means, including said framing bars, for distributing said torsional forces to said walls of the guitar body.

9. A bracing structure as claimed in claim 1 wherein the cross sectional area of said framing bars decrease as the bars extend away from said torsion bar.

10. A bracing structure as claimed in claim 1 wherein the cross sectional area of said torsion bar is less near the ends of the bar than it is near the center of the bar.

11. In a stringed musical instrument having lower frequency or bass strings and higher frequency or treble strings and a soundboard to which the strings are coupled through a bridge structure, a bracing structure formed on the underside of said soundboard, said structure comprising:

a plurality of acoustical bars attached to the underside of the soundboard and oriented in a predetermined pattern, said bar pattern being adapted to permit said soundboard to vibrate optimally at different frequencies in different zones thereof; and boundary means for limiting the zones of the soundboard which may vibrate at selected frequency ranges and for preventing the formation of antinodes outside of these limited zones, said boundary means including at least one peripheral bar attached to the underside of said soundboard and positioned substantially at the junction between said limited zones and a region outside of said limited zones, and stiffening bars attached to the underside of the soundboard in the outside region, said stiffening bars being oriented at an angle substantially perpendicular to the peripheral bar at the junction of the outside region in which the stiffening bar is positioned.

12. A bracing structure as claimed in claim 11 wherein the cross-sectional area of the stiffening bars decreases as the bars extend away from the peripheral bar, being a minimum at the end farthest from the peripheral bar.

13. A bracing structure as claimed in claim 11 wherein said stiffening bars are each attached at one end to the peripheral bar and extend therefrom into said outside region.

14. A bracing structure as claimed in claim 11 wherein higher frequency vibrations of said soundboard occur in relatively small zones centered substantially under the portion of said bridge structure coupled by the treble strings, and lower frequency vibrations occur in relatively larger zones centered substantially under the portion of said bridge structure coupled by the bass strings; and wherein said boundary means includes means for delimiting the zones in which said higher frequency vibrations occur.

15. A bracing structure as claimed in claim 14 wherein said predetermined pattern for the acoustical bars includes longer bars in the zones having lower frequency vibrations and shorter bars in the zones having higher frequency vibrations, said acoustical bars radiating generally from the bridge area to the boundary of the selected zone.

16. A bracing structure as claimed in claim 15 wherein said boundary means includes a periphery bar attached to the underside of said soundboard along at least a portion of both the upper and lower boundaries of the zones in which higher frequency vibrations occur.

17. A bracing structure as claimed in claim 14 wherein said pheripheral bar is positioned a predetermined distance from the treble side of the bridge and extends at an angle to the axis of the bridge such that the distance of the bar from the bridge increases as the bar extends toward the bass side of the bridge.

18. A bracing structure as claimed in claim 17 wherein said peripheral bar is substantially straignt and extends at an acute angle to the bridge axis.

19. A bracing structure as claimed in claim 17 wherein said peripheral bar is curved so that the rate of increase in distance of the bar from the bridge increases as the bar extends toward the bass zones.

20. A bracing structure as claimed in claim 14 wherein acoustical bars located in zones of the soundboard having higher frequency vibrations have higher aspect ratios than acoustical bars located in regions adapted for lower frequency vibration.

21. In a stringed musical instrument having a soundboard, a bridge and strings extending over said bridge longitudinally of said soundboard, a bracing structure comprising:

a torsion bar fixed to the underside of said soundboard under said bridge and positioned substantially in axial alignment with said bridge, said torsion bar having a relatively thick dimension perpendicular to said soundboard;

framing means including a plurality of framing bars fixed to the underside of said soundboard and extending generally longitudinally of said soundboard, each of said framing bars having one end abutting said perpendicular dimension of said torsion bar, whereby torsional forces applied by said strings to said bridge are transmitted to said torsion bar and distributed from the bridge area of the soundboard by said framing bars; and a plurality of acoustical bars attached to the underside of the soundboard and oriented in a predetermined pattern, said bar pattern being adapted to permit said soundboard to vibrate optimally at different frequencies in different zones thereof.

22. A bracing structure as claimed in claim 21, wherein said framing bars are attached at said one end to said torsion bar.

23. A bracing structure as claimed in claim 21 wherein at least one of said framing bars also functions as an acoustical bar.

24. A bracing structure as claimed in claim 21 wherein said instrument is a guitar, the soundboard of the guitar having a narrowed waist at a predetermined distance above said bridge; including a waist bar positioned at the underside of the soundboard waist, said waist bar being at least partially floating; and wherein at least some of said framing and acoustical bars pass under said waist bar.

* * * * *